US006375479B1

(12) United States Patent
Johnson et al.

(10) Patent No.: US 6,375,479 B1
(45) Date of Patent: Apr. 23, 2002

(54) RETRACTABLE CONNECTOR WITH AN ALIGNMENT MECHANISM FOR USE WITH ELECTRONIC DEVICES

(75) Inventors: Thomas A. Johnson, Draper; Jeffrey L. Jones, Orem; David Oliphant, Salt Lake City; Steven Lo Forte, Midvale, all of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/652,547

(22) Filed: Aug. 31, 2000

(51) Int. Cl.[7] ..... H01R 13/44
(52) U.S. Cl. ..... 439/131; 439/946
(58) Field of Search ..... 439/131, 946, 439/676, 344

(56) References Cited

U.S. PATENT DOCUMENTS

| | | | | |
|---|---|---|---|---|
| 2,916,720 | A | 12/1959 | Steans | 339/91 |
| 4,186,988 | A | 2/1980 | Kobler | 339/176 MP |
| 4,241,974 | A | 12/1980 | Hardesty | 339/154 A |
| 4,303,296 | A | 12/1981 | Spaulding | 339/122 R |
| 4,352,492 | A | 10/1982 | Smith | 273/1 GC |
| 4,407,559 | A | 10/1983 | Meyer | 339/126 R |
| 4,428,636 | A | 1/1984 | Kam et al. | 339/97 P |
| 4,710,136 | A | 12/1987 | Suzuki | 439/374 |
| 4,778,410 | A | 10/1988 | Tanaka | 439/676 |
| 4,915,648 | A | 4/1990 | Takase et al. | 439/490 |
| 5,035,641 | A | 7/1991 | Van-Santbrink et al. | 439/329 |
| 5,051,099 | A | 9/1991 | Pickles et al. | 439/108 |
| 5,139,439 | A | 8/1992 | Shie | 439/359 |
| 5,183,404 | A | 2/1993 | Aldous et al. | 439/55 |
| 5,184,282 | A | 2/1993 | Kaneda et al. | 361/395 |
| 5,336,099 | A | 8/1994 | Aldous et al. | 439/131 |
| 5,338,210 | A | 8/1994 | Beckham et al. | 439/131 |
| 5,391,094 | A | 2/1995 | Kakinoki et al. | 439/638 |
| 5,411,405 | A | 5/1995 | McDaniels et al. | 439/131 |
| 5,481,616 | A | 1/1996 | Freadman | 381/90 |
| 5,499,923 | A | 3/1996 | Archibald et al. | 439/26 |
| 5,505,633 | A | 4/1996 | Broadbent | 439/329 |
| 5,509,811 | A | 4/1996 | Homic | 439/55 |
| 5,538,442 | A | 7/1996 | Okada | 439/676 |
| 5,547,401 | A | 8/1996 | Aldous et al. | 439/676 |
| 5,561,727 | A | 10/1996 | Akita et al. | 385/88 |
| 5,562,504 | A | 10/1996 | Moshayedi | 439/638 |

(List continued on next page.)

FOREIGN PATENT DOCUMENTS

| | | |
|---|---|---|
| EP | 0 355 413 | 7/1989 |
| JP | 58-34370 | 5/1983 |
| JP | 61-256850 | 11/1986 |
| WO | WO 95/13633 | 5/1995 |

OTHER PUBLICATIONS

IBM Technical Disclosure Bulletin, "Electrical Connector For Flat Flexible Cable," vol. 25, No. 1, Jun. 1982.

*Primary Examiner*—P. Austin Bradley
*Assistant Examiner*—Ross Gushi
(74) *Attorney, Agent, or Firm*—Workman, Nydegger & Seeley

(57) ABSTRACT

The present invention provides a retractable connector with a guide structure for use with electronic devices. The guide structure minimizes the lateral movement of the retractable connector and helps ensure that the retractable connector moves smoothly between the extended and retracted positions. The retractable connector and guide structure are preferably used in conjunction with multiple receptacles so that the connector can be connected to more than one communication system or network simultaneously. Advantageously, the guide structure allows the retractable connector to have a larger size while permitting smooth and controlled movement of the connector. The large size retractable connector can also include one or more antennas used for wireless communication.

31 Claims, 6 Drawing Sheets

U.S. PATENT DOCUMENTS

| | | | | |
|---|---|---|---|---|
| 5,608,607 | A | | 3/1997 | Dittmer ..... 361/686 |
| 5,634,802 | A | | 6/1997 | Kerklaan ..... 439/131 |
| 5,660,568 | A | | 8/1997 | Moshayedi ..... 439/654 |
| 5,667,390 | A | | 9/1997 | Keng ..... 439/76.1 |
| 5,667,395 | A | | 9/1997 | Okada et al. ..... 439/131 |
| 5,679,013 | A | | 10/1997 | Matsunaga et al. ..... 439/144 |
| 5,727,972 | A | | 3/1998 | Aldous et al. ..... 439/655 |
| 5,773,332 | A | * | 6/1998 | Glad ..... 439/344 |
| 5,797,771 | A | | 8/1998 | Garside ..... 439/610 |
| 5,816,832 | A | | 10/1998 | Aldous et al. ..... 439/131 |

* cited by examiner

RETRACTABLE CONNECTOR WITH AN ALIGNMENT MECHANISM FOR USE WITH ELECTRONIC DEVICES

BACKGROUND OF THE INVENTION

1. Field of the Invention

The present invention generally relates to retractable connectors that facilitate electrical communication between electronic devices. More particularly, the present invention relates to a spring driven system with an alignment mechanism that smoothly moves the retractable connector.

2. Description of Related Art

Electronic devices are widely used and have often become an indispensable resource for businesspersons, students and others. For example, the use of personal digital assistants (PDAs), laptop computers, palm computers, portable computers, mobile telephones and other types of electronic devices are becoming commonplace and new electronic devices, such as digital music players and cameras, are being introduced. Significantly, many of these electronic devices are readily portable and designed to be used in a variety of situations.

Electronic devices, such as portable computers, are also beginning to provide functionality to users beyond their original purpose. For example, many conventional portable computers did not provide a user with access to remote computer systems such as the Internet. Today, however, many computers provide a user with the ability to access remote computer networks or systems, including the Internet. The ability to access these remote computer systems, however, requires a connection that allows the computer to communicate with the remote computer system. Accordingly, many conventional portable computers require an interface that permits the computer to be connected with the Internet or other computer system.

Frequently computer expansion cards are used with conventional computers to allow a user to access the Internet or other remote computer networks. Known expansion cards, such as modem cards, often include a retractable platform that can be stored inside the card in a retracted position or it can extend outwardly from the card in an extended position. In the extended position, a receptacle is exposed to receive a communication plug that allows the modem card to be connected to a telephone network. Thus, the retractable platform provides an electrical and physical interface between the modem card and the telephone network.

In greater detail, when the retractable platform is extended and the receptacle or jack portion is exposed, a communication plug is inserted into the receptacle. The communication plug is typically a RJ series connector plug and it is attached to one end of a cable. The other end of the cable may include another RJ series connector plug that is connected to the telephone network, which provides access to remote computer networks and systems such as the Internet. Thus, the modem card with the retractable platform allows portable computers to be electrically connected to the telephone network, which provides access to remote computer systems such as the Internet.

Conventional modem cards with retractable platforms typically include a slidable plate that slides within grooves or tracks in the modem card. The slidable plate includes the receptacle that receives the RJ series connector plug and the slidable plate is movable between the extended and retracted positions. A compression spring is attached to one side of the slidable plate and it assists in moving the plate between the extended and retracted positions. In particular, the compression spring aids in pushing the slidable plate into the extended position and holding it in that position. The compression spring also helps hold the slidable plate in the retracted position such that the plate is not inadvertently extended. Because the compression spring is located on one side of the slidable plate, it provides an uneven spring force on the plate. In addition, the compression spring creates a moment arm as the slidable plate is moved between the retracted and extended positions because the spring force is directed only towards one side of the plate.

Conventional modem cards may also include a flex circuit that electronically connects the retractable platform to the communication card. The flex circuit is located in the slot in the modem card that receives the retractable platform, and the flex circuit is repeatedly bent and straightened as the slidable plate is moved between the extended and retracted positions. Because the movement of the flex circuit is not constrained or controlled, the flex circuit may be caught between moving parts, or the flex circuit may become twisted, tangled or bent as the retractable platform is extended and retracted. This may cause the flex circuit to break, fracture, malfunction or otherwise stop working. In addition, the flex circuit may become loosened or even disconnected from either the retractable platform and/or the communication card because the movement of the flex circuit is not constrained. Disadvantageously, if the flex circuit malfunctions or becomes disconnected, the modem card cannot be used and this may prevent the user from communicating with the remote computer system. In addition, the flex circuit may be difficult to repair or replace because of the tight tolerances and small space in which the circuit is located.

SUMMARY OF THE INVENTION

A need therefore exists for a communication card with a retractable connector that provides effective and reliable communication with a remote computer or network system, and eliminates the above-described disadvantages and problems.

One aspect of the present invention is a communication card with a retractable connector that includes multiple connectors and/or receptacles, which allow the communication card to be connected to various communication systems. Advantageously, this enhances the functionality of the communication card because it can be connected to two or more communication networks either simultaneously or independently. For example, the retractable connector can include two receptacles in which one receptacle is sized to receive a RJ-11 series connector plug and the other receptacle is sized to receive a RJ-45 series connector plug. This allows the communication card to be connected to a telephone network and a computer network, such as a local area network (LAN) or a wide area network (WAN), at the same time or separately.

Another aspect is a communication card including a retractable connector with an increased size that provides additional room for a plurality of connectors and/or receptacles. The increased size of the retractable connector also allows other components to be mounted on the retractable connector. For example, the increased size may allow a plurality of connectors or receptacles, and/or one or more antennas or other devices for wireless communication to be mounted on the retractable connector. Therefore, the increased size may allow the retractable connector to be connected to a wireless system and/or a hard-wired system.

The retractable connector can be configured to allow the communication card to be connected to the wireless system and/or the hard-wired system either simultaneously or independently.

Yet another aspect is a communication card with a retractable connector that has an increased width to allow one or more connectors or receptacles to be mounted on the retractable connector. Advantageously, the increased width allows multiple connectors or receptacles to be mounted along the forward edge of the retractable connector. In addition, the increased width allows an antenna or other wireless devices to be mounted on the retractable connector. Significantly, the increased width may also allow two or more antennas or wireless devices to be mounted on the retractable connector and separated by a suitable distance. The retractable connector could also have an increased length and other configurations that are appropriate for the intended use of the retractable connector.

Still another aspect is a communication card with a guide structure that guides the movement of the retractable connector. The guide structure advantageously controls the extension and retraction of the retractable connector, and the guide structure allows the retractable connector to be smoothly extended and retracted. The guide structure includes a guidepost and an elongated slot located in the retractable connector. The elongated slot is generally centrally located within the retractable connector and aligned with the longitudinal axis upon which the retractable connector is extended and retracted. The guide structure permits the retractable connector to be extended and retracted along the longitudinal axis, and it prevents the platform from moving laterally. The guide structure also prevents the retractable connector from being unintentionally removed from the communication card. Significantly, the guide structure increases the structural integrity of the communication card, while preventing the retractable connector from moving roughly, hesitating or becoming stuck.

Another aspect is a communication card including a retractable connector with a guide structure and a compression spring. The compression spring is mounted between the guidepost and one end of an elongated slot, and it aids in moving the retractable connector between the extended and retracted positions. The compression spring also helps hold the retractable connector in a retracted position so that the connector is not inadvertently extended. Preferably, the compression spring has a generally constant or linear spring force such that the retractable connector is extended and retracted at a generally uniform rate. In addition, the elongated slot and compression spring are preferably centrally located in the retractable connector and generally aligned with the longitudinal axis upon which the connector is extended and retracted. Significantly, because the spring force is generally centrally located with respect to the retractable connector and aligned with the longitudinal axis in which the platform is extended or retracted, the retractable connector moves in a relatively smooth and constant manner.

In contrast, the spring force in connection with a conventional retractable platform is directed towards one side of the retractable platform because a compression spring is attached to that side of the platform. This creates an uneven spring force on the platform and that often causes the platform to hesitate, bind or stick, or otherwise move in a non-uniform manner. The uneven spring force also creates a moment arm that increases as the size of the retractable platform increases. Thus, a conventional compression spring attached to one side of the retractable platform may not function as originally intended if the size of the retractable platform is increased.

Still another aspect is a communication card with a retractable connector with a guide structure and a torsion spring. The torsion spring preferably includes a first end that engages the communication card and a second end that engages the retractable connector. The torsion spring is preferably generally U-shaped, but it can also have other suitable arrangements or configurations. The spring force of the torsion spring is preferably generally aligned with the center portion of the retractable connector and along the longitudinal axis upon which the connector is extended and retracted. Because the spring force is generally centrally aligned with the retractable connector and along the axis upon which the connector is extended and retracted, the connector smoothly extends and retracts without binding, sticking or twisting. The torsion spring preferably has a generally constant or linear spring force for more uniform movement of the retractable connector. Advantageously, the positioning of the torsion spring may be adjustable such that the direction of the spring force is also adjustable.

Yet another aspect is a communication card with one or more cutouts or notches that are sized and configured to receive the torsion spring when the retractable connector is in the retracted position. Significantly, the cutouts or notches allow the torsion spring to have a relatively large radius of curvature and the spring is not excessively compressed, deformed or pinched in the retracted position. Advantageously, the cutouts or notches can be located in the retractable connector and/or a portion of the communication card, such as the printed circuit board. The cutouts and notches also guide the torsion spring into a storage position and help prevent damage to the torsion spring.

Another aspect is a communication card with a flexible circuit attached to the torsion spring. Because the flexible circuit is attached to the torsion spring, it helps control the movement of the circuit and that improves the life of the circuit. For example, because the torsion spring has a relatively large radius of curvature, the flexible circuit also has a relatively large radius of curvature. This prevents the flexible circuit from being excessively compressed, pinched or twisted, and this prolongs the life of the circuit. In addition, the flexible circuit has greater reliability and integrity because the circuit has a larger bending radius and is subjected to less force. Further, because the flexible circuit is contained within the sidewalls of the housing of the communication card, this protects the circuit from damage. Additionally, because the flexible circuit is generally a constant distance from the housing, this improves the performance and reliability of the circuit because there is little or no impedance change.

Still another aspect is a communication card with a flexible circuit that electrically connects the retractable connector to the body of the communications card by a pair of connectors. The connectors are preferably zero insertion force (ZIF) connectors that require very little force and effort to connect the flexible circuit to the communication card and the retractable platform. Advantageously, the ZIF connectors position the flexible circuit in the desired location and allow an automated process to connect the flexible circuit to the communication card and the retractable connector. Significantly, because the torsion spring is also attached to the flexible circuit, the ZIF connectors also position the torsion spring in the desired location.

Additional aspects, features and advantages of the present invention will become more apparent from the following detailed description of the preferred embodiments and appended claims.

BRIEF DESCRIPTION OF THE DRAWINGS

The appended drawings contain figures of preferred embodiments of the communication card with a retractable connector. The above-mentioned features, aspects and advantages of the communication card with a retractable connector, as well as other features, aspects and advantages, will be described in connection with the preferred embodiments. The illustrated embodiments, however, are only intended to illustrate the invention and not limit the invention. The drawings contain the following figures.

DETAILED DESCRIPTION OF THE PREFERRED EMBODIMENTS

The present invention is generally directed towards a retractable connector for use with an electronic device. The retractable connector is preferably attached to a communication card to allow an electronic device such as a computer to communicate with another electronic device or communication system. The principles of the present invention, however, are not limited to a retractable connector for a communication card. It will be understood that, in light of the present disclosure, the retractable connector can successfully be used in connection with other types of electrical equipment, electrical devices and communication systems.

Additionally, to assist in the description of the retractable connector and communication card, words such as top, bottom, front, rear, right and left are used to describe the accompanying figures. It will be appreciated, however, that the present invention can be used in a variety of desired positions-including various angles, sideways and even upside down. Further, one skilled in the art will appreciate that the various components of the retractable connector and communication card, which are described in more detail below, can be located in other suitable locations and positions. A detailed description of the preferred embodiments of the retractable connector now follows.

Figure 1:
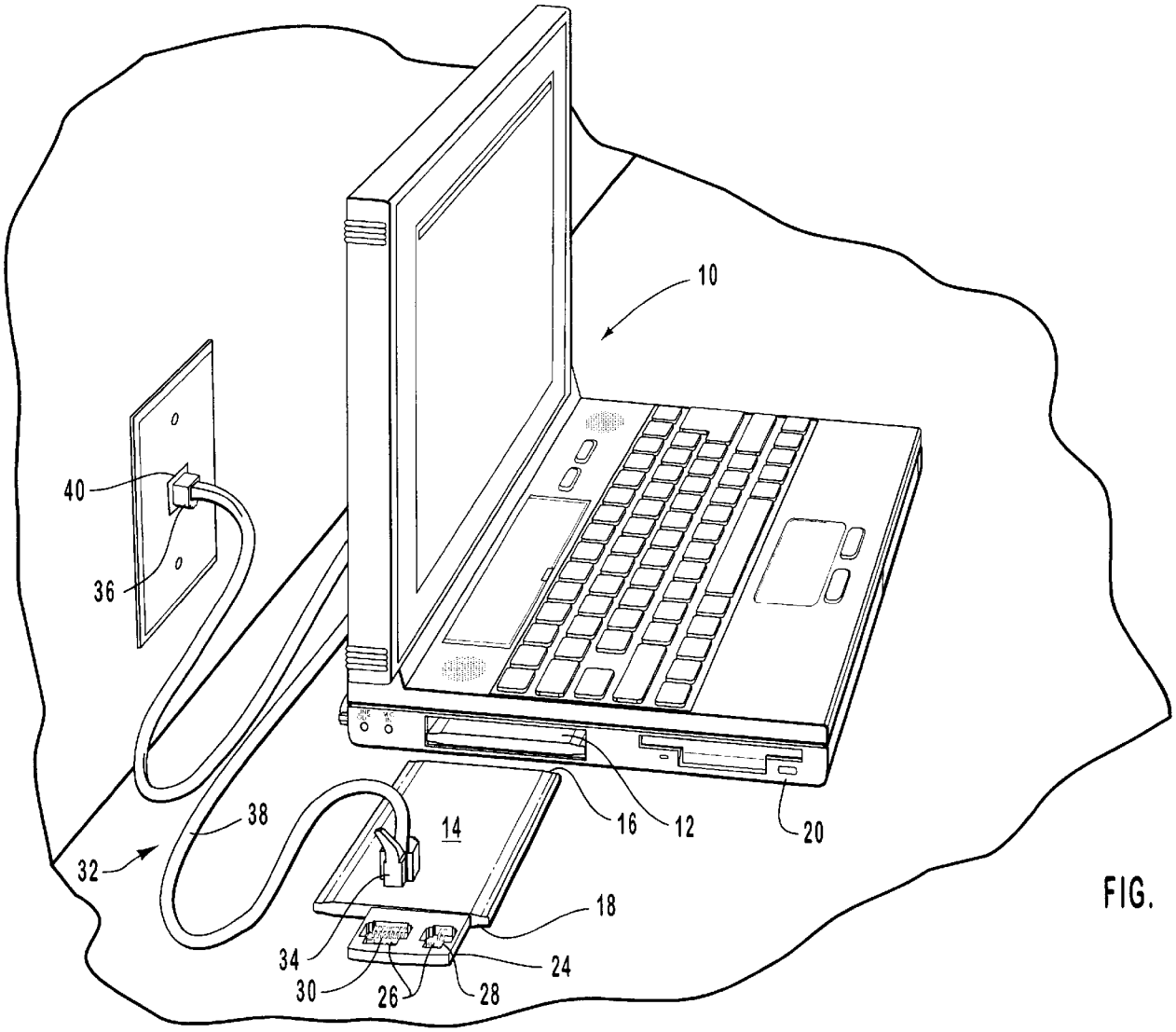
FIG. 1 is a perspective view of a communication card with a retractable connector in accordance with a preferred embodiment of the present invention, illustrating the communication card in connection with a portable or laptop computer.

FIG. 1 illustrates a computer 10 including a slot 12 that is configured according to Personal Computer Memory Card International Association (PCMCIA) standards to receive a communications card 14, which is also configured according to the PCMCIA standards. The PCMCIA standards are well known to those skilled in the art and are available from the Personal Computer Memory Card International Association of Santa Clara, Calif. These standards allow for the interchangeability of communication cards developed by different manufacturers. One skilled in the art will appreciate that the slot 12 and/or the communication card 14 may have other suitable configurations and characteristics, and neither the slot nor the communication card has to comply with the PCMCIA standards.

The computer 10 is capable of performing additional functions when the communication card 14 is inserted into the slot 12. For instance, the communication card 14 may be a modem or a network interface card that provides the computer 10 with the ability to interface with a telephone based system or with a computer network. One skilled in the art will appreciate that the communication card 14 can be used to perform a wide variety of desired functions. The communication card 14 can also include additional features, such as increased memory.

Figure 2:
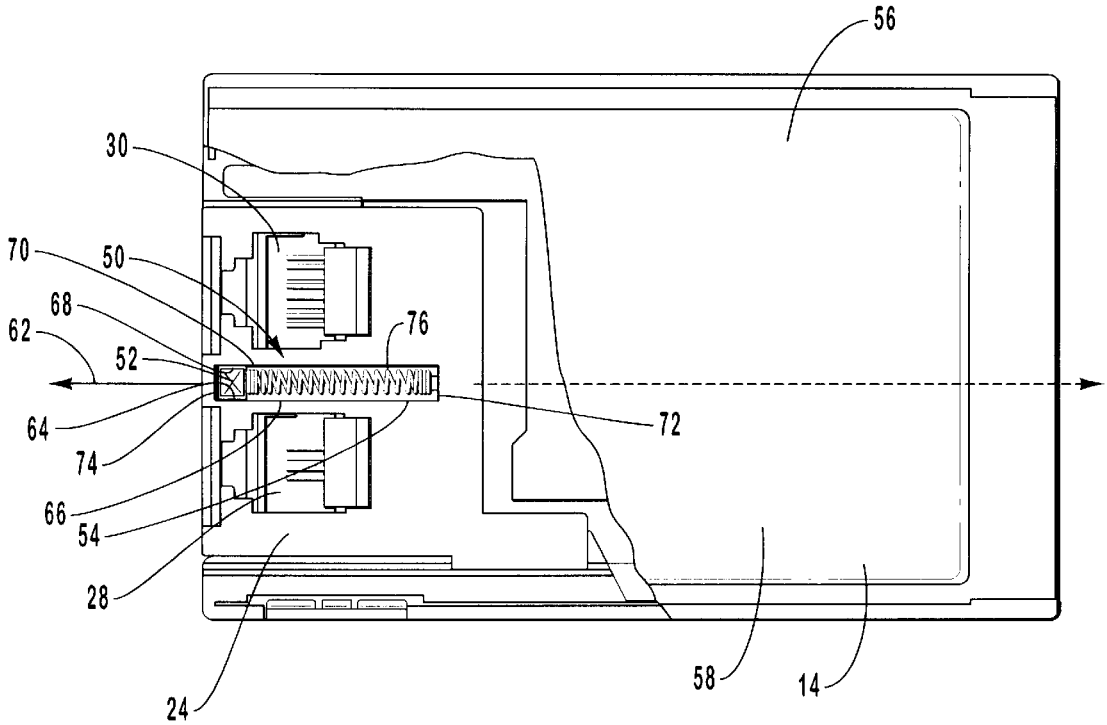
FIG. 2 is a top view of the communication card shown in FIG. 1, with a portion of the communication card cut away, illustrating the retractable connector in a retracted position.
Figure 3:
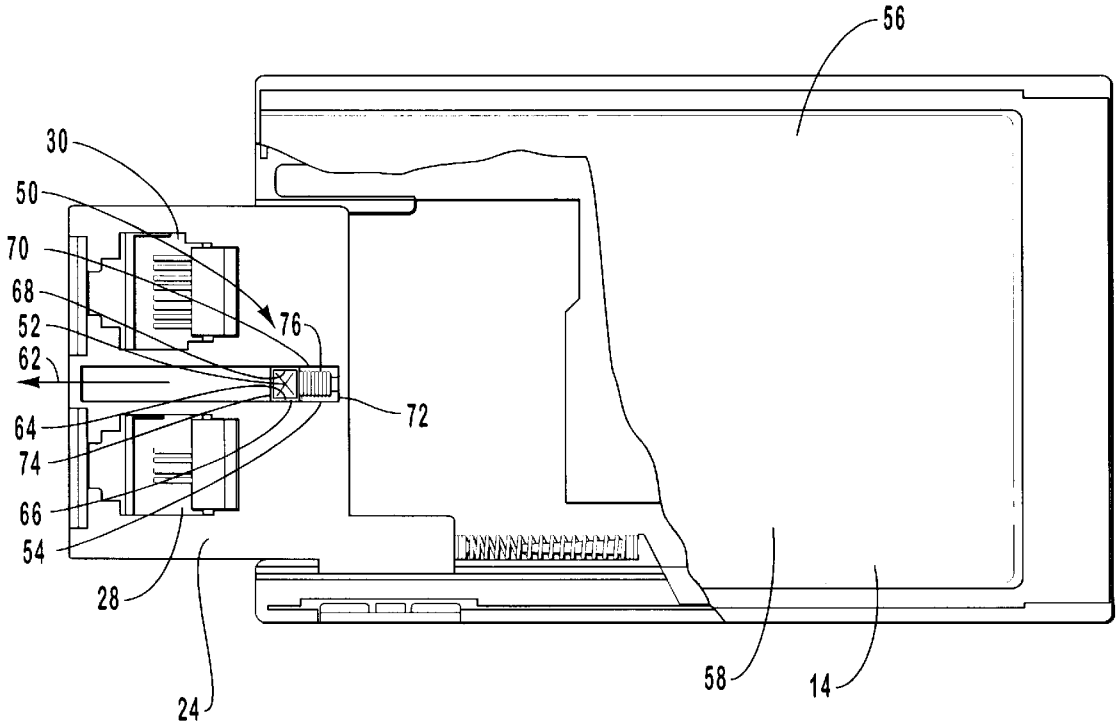
FIG. 3 is a top view of the communication card shown in FIG. 2, illustrating the retractable connector in an extended position.

As shown in FIG. 1, the communication card 14 includes an insertion end 16 that is inserted into the slot 12 where it is electrically and mechanically coupled to the computer 10. When the card 14 is fully inserted within the slot 12, the outward end 18 of the card 14 is preferably flush with the sidewall 20 of the computer 10. The card 14 further comprises a retractable connector or platform 24 that is located in the outward end 18 of the card 14. The retractable connector 24 may be either retracted or extended as desired by the user. In particular, as seen in FIG. 2, the retractable connector 24 is movable between a retracted position wherein the connector 24 can be stored within the body of the communication card 14 and, as seen in FIG. 3, an extended position wherein a portion of the connector extends outwardly from the body of the communication card 14. It will be appreciated, however, that the retractable connector 24 does not have to be used in connection with a communication card 14 and, for example, the retractable connector can be directly connected to an electronic device such as a cellular telephone, digital camera, etc.

The retractable connector 24 shown in the accompanying figures includes dual jacks, receptacles or receiving portions 26 that allow a user to connect the communication card 14 to suitable networks, communication systems, computer systems and the like. As shown in the accompanying figures, the first receiving portion 28 is sized and configured to receive a RJ-11 series connector plug and the second receiving portion 30 is sized and configured to receive a RJ-45 series connector plug. The RJ-11 series connector plug is typically used to connect the retractable connector 24 to a telephone network and the RJ-45 series connector plug is often used to connect the retractable connector to a local area network (LAN). Thus, the retractable connector 24 has an increased width to provide additional room for multiple connectors and/or receiving portions 26. Advantageously, the multiple connectors may be configured to allow the retractable connector 24 to be connected to two different systems or networks simultaneously.

One skilled in the art will appreciate that the retractable connector 24 can include any number or type of connectors or receiving portions 26 such that the communication card 14 can be connected to any suitable number or type of communication systems or networks. For example, the retractable connector 24 may include one or more connectors or receiving portions 26 that are configured to be connected to communication systems such as a telephone network, LAN, wide area network (WAN), Internet, Ethernet, and the like. Additionally, the retractable connector 24 may be attached to these communication systems either at the same time or separately, which allows the communication card 14 to be configured to communicate with these systems either simultaneously or independently. Further, as discussed below, the retractable connector 24 can include other types of connectors that allow, for example, wireless or infrared communication.

FIG. 1 also illustrates a cable and plug assembly 32 that is used to connect the communication card 14 to a computer network or telephone system. The cable and plug assembly 32 includes plugs 34 and 36 that are attached to the ends of a cable 38. The first plug 34 is an RJ series connector plug that is removably connectable to a corresponding receptacle or jack 26 in the retractable platform 24. As discussed above, the first receptacle 28 is preferably configured to receive a RJ-11 plug and the second receptacle 30 a RJ-45 plug, but the receptacles and plugs can be of any suitable type, style, kind or configuration. The second plug 36, which is attached to the other end of the cable 38, is also an RJ series connector plug and it is removably connectable to a wall jack 40, which provides an interface to a telephone system or a computer network. Of course, the plug 36 can also be directly connected to the system or network, or to any appropriate communication system.

While the retractable connector 24 is described in detail in connection with a communication card 14 that is configured to be received within a corresponding slot 12 in a computer 10, those skilled in the art will appreciate that the communication card and the retractable connector may be used in conjunction with various types of computers including personal computers, notebook computers, hand-held devices, personal data assistants (PDAs), multi-processor systems, microprocessor-based or programmable consumer electronics, network PCs, minicomputers, mainframe computers, etc. In addition, the retractable connector 24 can be directly connected to various electronic devices such as cameras, telephones, pagers and the like.

As shown in FIGS. 2 and 3, the retractable connector 24 includes a guide structure 50 for guiding the extension and retraction of the connector. The retractable connector 24 is shown in the retracted position in FIG. 2 and in the extended position in FIG. 3. The guide structure 50 includes a guidepost 52 and an elongated slot 54. The guidepost 52 is connected to the housing 56 of the communication card 14 and, in particular, to the upper and lower covers 58 and 60 of card. The covers 58 and 60 may be constructed from dielectric materials, such as plastic, or conductive materials such as metal. Similarly, the guidepost 52 may be constructed from dielectric or conductive materials, and the guidepost may be connected to the covers 58 and 60 by welding, ultrasonic bonding, adhesives, and the like. Advantageously, the guidepost 52 increases the strength and structural integrity of the communication card 14 because it helps prevent the housing from collapsing or deforming. In addition, the guidepost 52 helps prevent debris and foreign matter from entering the communication card 14 because it prevents the covers 58 and 60 from being separated or spaced apart more than a desired distance away from the retractable connector 24.

The guidepost 52 is positioned within the elongated slot 54 and the sides of the post are configured to slidingly engage the sides of the elongated slot. As shown in FIGS. 2 and 3, the elongated slot 54 is generally centrally positioned within the retractable connector 24 and aligned with a longitudinal axis 62 extending through the communication card 14. The retractable connector 24 is extended and retracted along the longitudinal axis 62, and the guide structure 50 ensures that retractable connector moves along the longitudinal axis.

In greater detail, as the retractable connector 24 is extended and retracted, the right side 64 of the guidepost 52 slidingly engages the right inner surface 66 of the elongated slot 54, and the left side 68 of the guidepost slidingly engages the left inner surface 70 of the elongated slot. Thus, the guidepost 52 and elongated slot 54 guide the movement of the connector 24 along the longitudinal axis 62, and prevent the connector from excessive lateral or side-to-side movement. Advantageously, the slot 54 also has a length that prevents the retractable connector 24 from being over extended or over retracted. Thus, the connector 24 is able to extend until the guidepost 52 comes into contact with an end 72 of the slot 54, at which point further extension of the connector is prevented. Similarly, the other end 74 of the elongated slot 54 is configured to contact the guidepost 52 before the connector 24 is excessively retracted. Thus, the guide structure 50 provides the retractable connector 24 with a full range of motion in the extension and retraction directions, while preventing damage to the connector and minimizing the lateral movement of the connector. Of course, one skilled in the art will appreciate that the guide structure 50, guidepost 52 and the elongated slot 54 can have other suitable shapes and configurations depending, for example, upon the intended purpose of the guide structure.

The guide structure 50 also provides a locking feature that prevents the retractable connector 24 from being unintentionally removed from the communication card 14. In particular, because the guidepost 52 is located within the elongated slot 54, the guide structure 50 prevents the retractable connector 24 from being pulled out of the slot in the communication card 14. Thus, the guide structure 50 also prevents the retractable connector 24 from being lost.

The guide structure 50 also includes a compression spring 76 located within the elongated slot 54. The compression spring 76 is located within the elongated slot 54 such that one end abuts the guidepost 52 and the opposing end abuts the end 72 of the slot. The compression spring 76 provides a spring force that is used during the extension and retraction of the connector 24. Because the compression spring 76 is centrally located within the retractable connector 24 and generally aligned with the direction of travel of the retractable connector, it helps ensure that the connector operates smoothly and without binding. The compression spring 76 preferably has a generally constant or linear spring force such that the retractable connector 24 moves at a generally uniform rate. Thus, the guide structure 50 with the guidepost 52, elongated slot 54 and compression spring 76 ensures that the retractable connector 24 is smoothly extended and retracted, while restricting the lateral movement of the connector.

Figure 4:
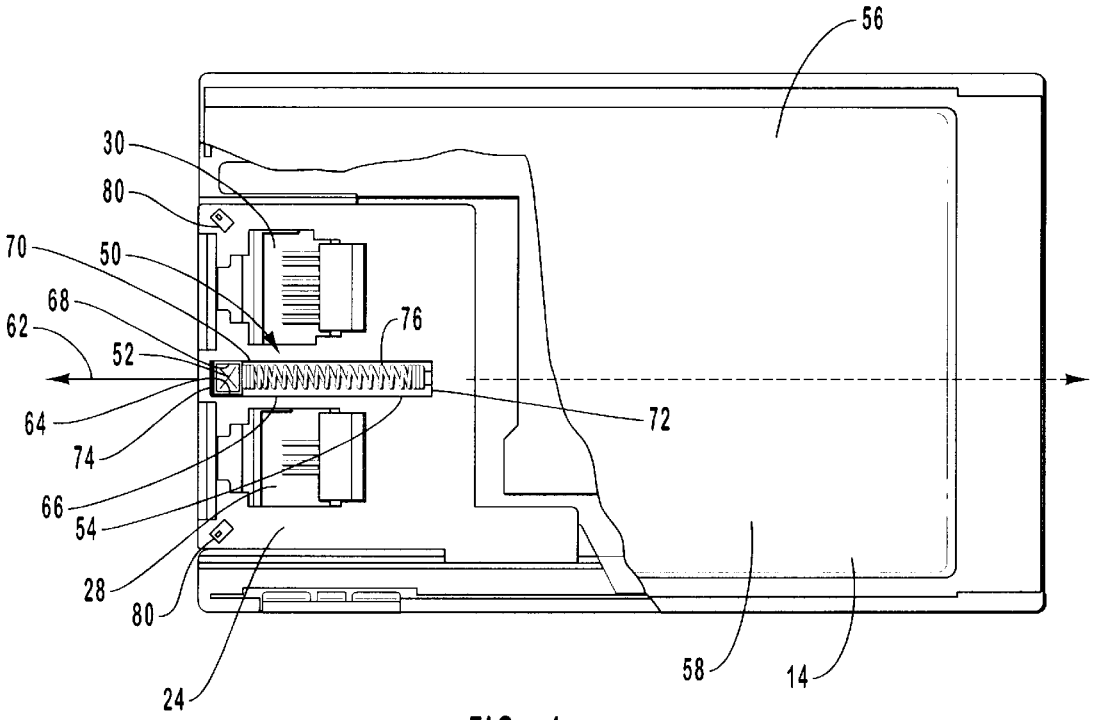
FIG. 4 is a top view of a communication card with a retractable connector in accordance with another preferred embodiment of the present invention, illustrating antennas attached to the retractable connector.

As seen in FIG. 4, the retractable connector 24 can also be used in conjunction with a wireless system. For example, the retractable connector 24 can include one or more antennas 80 to provide an interface with an external wireless system. Advantageously, the larger width of the retractable connector 24 allows the antennas 80 to be positioned in the desired locations and separated by the desired distance. For example, the antennas 80 may be separated by a distance of 1.2 inches, or greater. This separation permits the antennas 80 to be used with various wireless communication systems, such as wireless systems that incorporate Bluetooth technology or systems compatible with the IEEE (Institute of Electrical and Electronics Engineers) standard 802.11 for wireless communication. Of course, one skilled in the art will recognize that the number and/or distance separating the antennas may depend, for example, upon the type of wireless communication system.

As shown in FIG. 4, the antennas 80 are positioned proximate to the corners of the retractable connector 24 and the connector includes two jacks or receiving portions 26. It will be appreciated that the antennas 80 can be used in combination with one or more receiving portions 26, but the wireless system does not require the use of any receiving portions. Advantageously, the antennas 80 are solely located in the retractable connector 24 and no portions of the antennas are moved or extended relative to the retractable connector. Thus, in order to extend the antennas 80 from the communication card 14, the retractable portion 24 is simply extended from the card and the antennas themselves do not have to be moved or manipulated. This greatly simplifies the use of the communication card 14 in conjunction with a wireless system.

The antennas 80 mounted on the retractable connector 24 are preferably chip antennas because they require a small area. For example, a Murata 8220 chip antenna manufactured by Murata Electronics North America, Inc. of Smyrna, Ga., may be used because it has a small size of about 4 mm by 1 mm by 20 mm. It will be appreciated, however, that other suitable antennas with different sizes and configurations may also be used.

Figure 5:
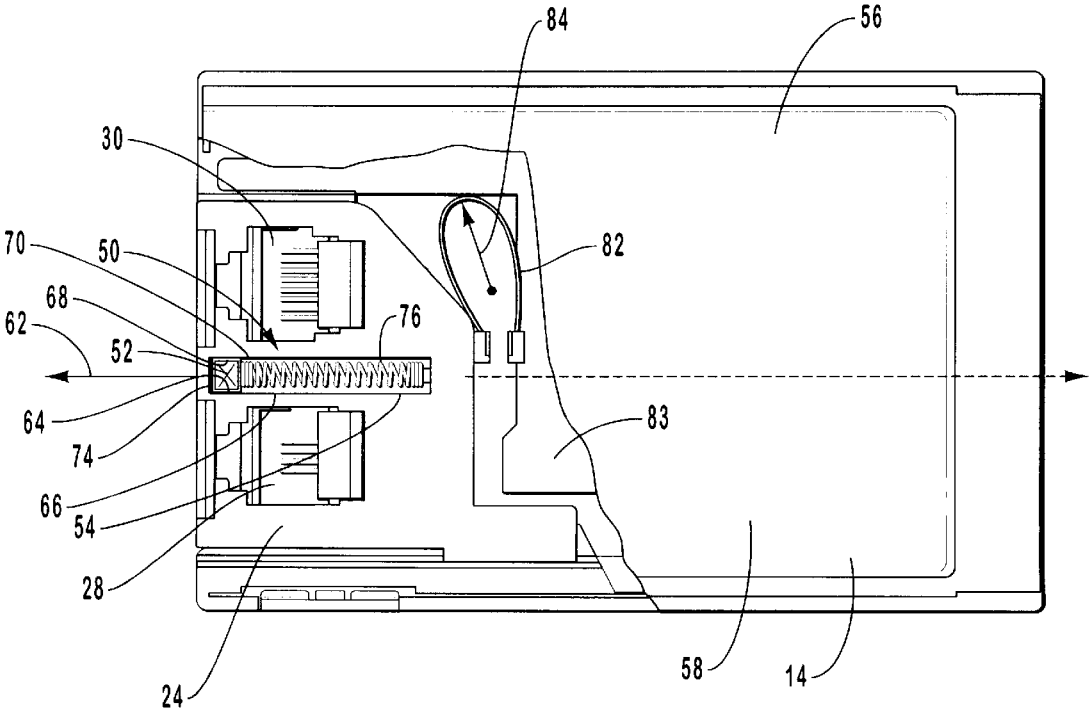
FIG. 5 is a top view of a communication card with a retractable connector in accordance with still another preferred embodiment of the present invention, illustrating a torsion spring positioned between the retractable connector and the communication card.

FIG. 5 illustrates another preferred embodiment of the retractable connector 24 connected to the communication card 14. The retractable connector 24 has generally the configuration as discussed above, and further includes a torsion spring 82 that is used in conjunction with the guide structure 50 to help control the movement of the retractable connector. The torsion spring 82 is disposed between the retractable connector 24 and a portion of the communication card 14, such as the printed circuit board or substrate 83. The torsion spring 82 has a generally U-shaped configuration and provides a generally constant or linear spring force as the spring is expanded and compressed. Thus, the torsion spring 82 assists in the smooth extension and retraction of the retractable connector 24. Advantageously, the torsion spring 82 can be used in combination with the compression spring 76 of the guide structure, or independently.

The torsion spring 82 is located such that the spring force exerted by the torsion spring is generally directed towards the center of the retractable connector 24 and along the longitudinal axis 62 in which the retractable connector is extended and retracted. By directing the spring force of the torsion spring 82 generally towards the center of the retractable connector 24 and along the longitudinal axis 62, the connector 24 may be smoothly retracted and extended. Significantly, because the spring force is aligned with the direction of travel of the connector 24, this helps prevent the connector from hesitating, binding, or sticking as it is extended or retracted.

The compression spring 76 and/or torsion spring 82 also help compensate for forces that may cause the retractable connector 24 to bind or otherwise malfunction as it is extended and retracted from the body of the communication card 14. For example, the springs 76 and 82 provide a force that counters a moment arm introduced by a user pushing on a side edge or corner of the retractable connector 24. Because the forces provided by the springs 76 and 82 are generally directed along the longitudinal axis 62 and towards the center of the retractable connector 24, this helps prevent the connector from being pushed in a lateral or side-to-side direction where the connector may move roughly or get stuck. Thus, the springs 76 and 82 help ensure that the retractable connector 24 will function as intended.

As shown in FIG. 5, in order to ensure that the torsion spring 82 maintains its elasticity and is not deformed in the retracted position, the torsion spring has a relatively large radius of curvature 84. As shown in the accompanying figurers, a portion of the retractable connector 24 is cut away such that the torsion spring 82 is not excessively compressed between the connector and the communications card 14. Alternatively, a portion of the communication card 14, such as the printed circuit board 83, may be cut away to ensure that the torsion spring 82 is not excessively compressed. One skilled in the art will also appreciate that a portion of both the communication card 14 and the retractable connector 24 may be cut away to accommodate the torsion spring 82 in a manner that protects the spring from damage.

Figure 6:
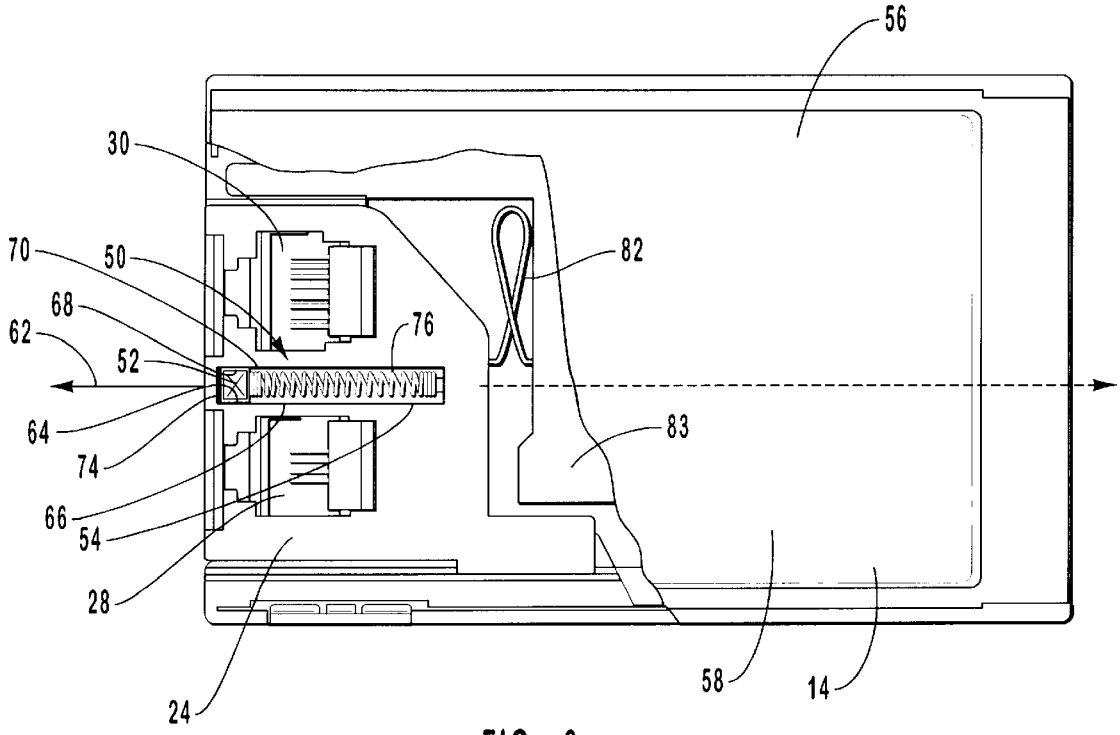
FIG. 6 is a top view of a communication card with a retractable connector in accordance with yet another preferred embodiment of the present invention, illustrating a torsion spring positioned between the retractable connector and the communication card.

One skilled in the art will appreciate that the torsion spring 82 can have other suitable configurations, such as that shown in FIG. 6. Further, the torsion spring 82 and/or guide structure 50, for example, can be used with other types of retractable connectors. For instance, the torsion spring 82 and/or guide structure 50 can be used with the connector disclosed in pending U.S. patent application Ser. No. 09/033,270, filed Mar. 2, 1998, entitled Electrical Connector for Use Between Media Connectors and Computer Communications Cards and assigned to the same assignee as the present application, which is hereby incorporated by reference in its entirety.

Figure 7:
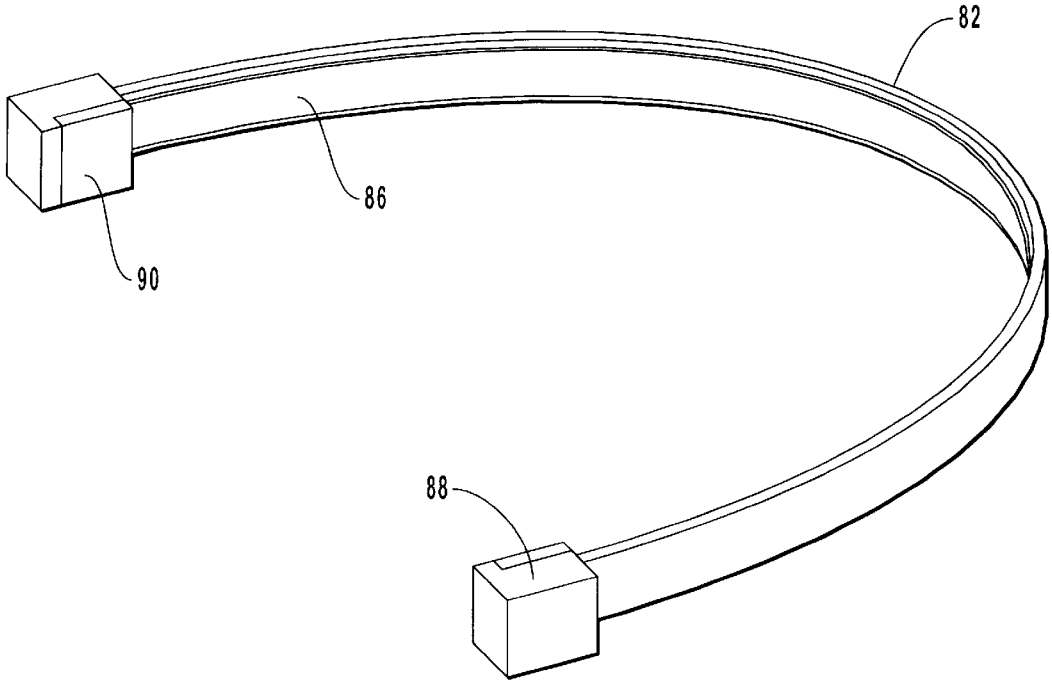
FIG. 7 is an enlarged perspective view of the torsion spring shown in FIG. 5, illustrating a flexible circuit attached to the torsion spring.

In another preferred embodiment, as seen in FIG. 7, a flexible circuit 86 is attached to the torsion spring 82 to allow electrical communication to be established between the retractable connector 24 and the communication card 14. The flexible circuit 86 is bonded on either or both sides of the torsion spring 82 by a pressure sensitive adhesive, but any suitable attachment may be used. Adhering or integrating the flexible circuit 86 with the torsion spring 82 provides the significant advantage of restraining or controlling the movement of the circuit, which prevents the circuit from being pinched between moving parts or otherwise damaged.

The flexible circuit 86 could also comprise a transmission line, which may be particularly useful when the retractable connector 24 includes antennas 80 for wireless communication, as discussed in detail in connection with FIG. 4. Advantageously, if the housing 56 of the communication card 14 is constructed of metal, such as the upper cover 58 and lower cover 60, the housing of the card protects the circuit 86 from external radiation and interference. Additionally, the torsion spring 82 may be comprised of a material that provides a ground plane for the circuit or transmission line 86 such that noise or radiation that may interfere with signal transmission and reception may be further reduced or eliminated. Additionally, bonding the flexible circuit 86 to the torsion spring 82 constrains the motion of the circuit and improves the durability and life of the circuit.

As best seen in FIG. 7, the flexible circuit 86 includes zero insertion force (ZIF) connectors 88 and 90 attached to the ends of the circuit. Advantageously, the ZIF connectors 88 and 90 lower manufacturing costs and improve reliability because they allow the flexible circuit 86 to be quickly and easily attached to the communication card 14 and the retractable connector 24. Additionally, the ZIF connectors 88 and 90 allow the flexible circuit 86 to be attached by an automated process, such as pick-and-place manufacturing. The ZIF connectors 88 and 90 also allow the torsion spring 82 to be positioned in the desired location between the communication card 14 and the retractable connector 24. It will be understood that while the torsion spring 82 is shown as being attached to the retractable connector 24 and the printed circuit board 83 of the communication card 14 by the connectors 88 and 90, the torsion spring may be connected to the connector and communication card using other methods. For example, the ends of the torsion spring 82 may rest within corresponding notches cut in the retractable connector 24 and the printed circuit board 83. Alternatively, the torsion spring 82 may be permanently connected to either the connector 24, the card 14 or to both the connector and the card.

Figure 8:
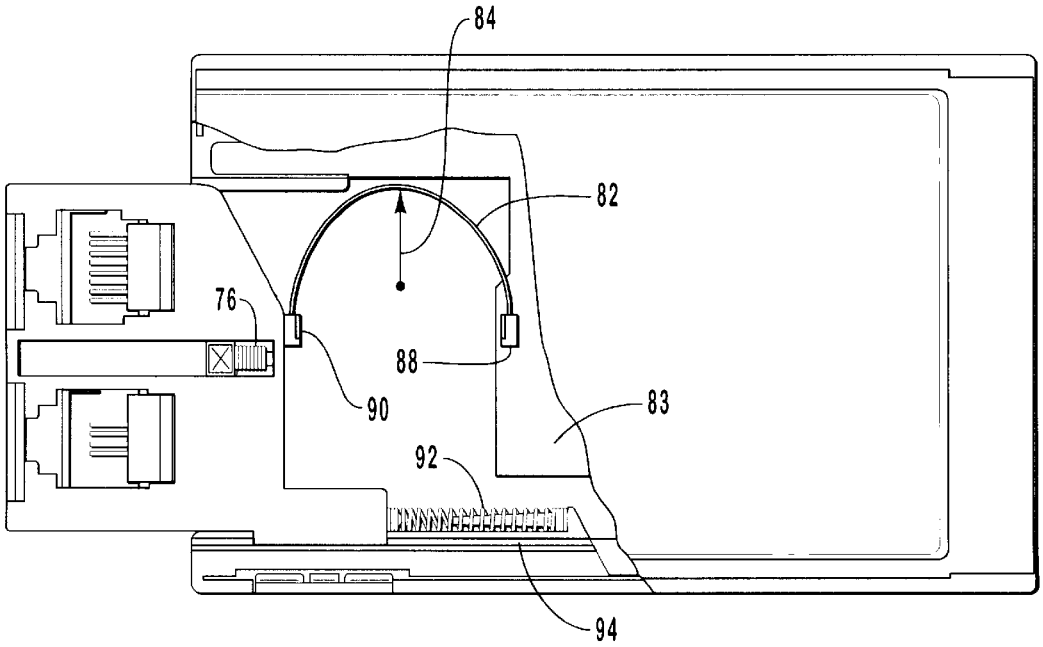
FIG. 8 is a top view of the communication card with a retractable connector in accordance with yet another preferred embodiment of the present invention, illustrating a track system that assists in moving the retractable connector.

FIG. 8 illustrates another preferred embodiment with a compression spring 92 attached to one side of the retractable connector 24. The compression spring 92 assists the compression spring 76 of the guide structure 50 in extending and retracting the connector in a smooth manner. In particular, the compression spring 92 provides additional force that assists the compression spring 92 in extending the connector 24. One skilled in the art will appreciate, however, that the compression spring 92 attached to a side of the retractable connector 24 does not have to be used with the compression spring 76 of the guide structure 50. Instead, the compression spring 92 may be used by itself to assist in moving the retractable connector between the extended and retracted positions. In addition, the compression spring 92 may be used in combination with the torsion spring 82. In this embodiment, the position and spring force of the torsion spring 82 are preferably adjusted so that the combined spring force of the torsion spring and the compression spring 92 is generally aligned with the longitudinal axis 62 extending through the center portion of the retractable connector 24. Thus, by aligning the spring force of the compression spring 92 and the torsion spring 82, the extension and retraction of the connector 24 is smooth and does not bind, hesitate, or stop.

Figure 9:
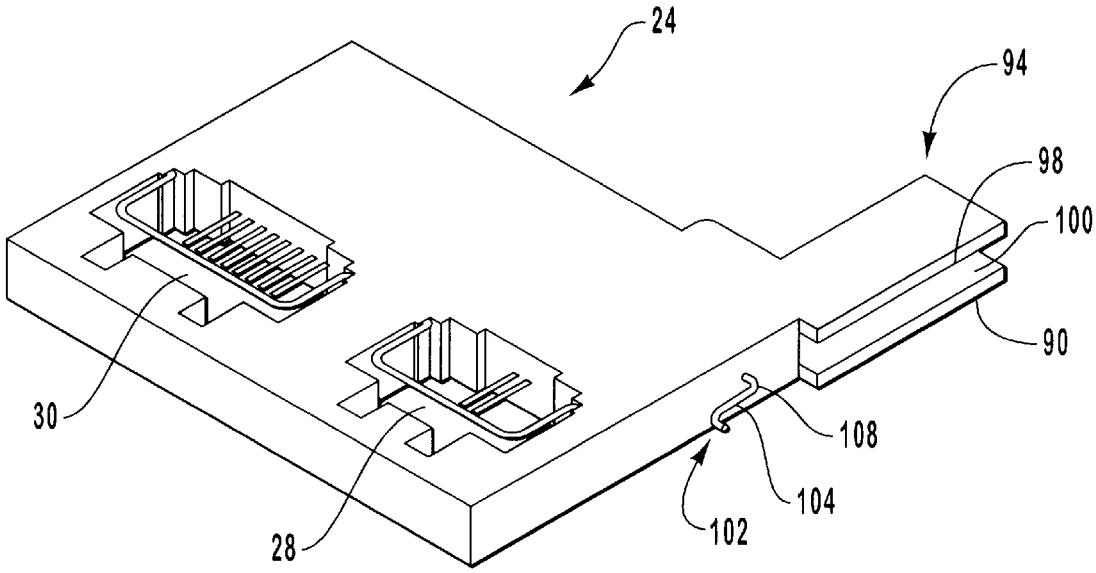
FIG. 9 is a perspective view of a portion of the communication card shown in FIG. 7, illustrating the retractable connector and a cam follower.

As seen in FIGS. 8 and 9, the compression spring 92 is located near a guide track 94 that assists in guiding the movement of the retractable connector 24. The guide track 94 includes a pair of rails 96 and 98 that fit within corresponding grooves (not shown) in the communication card 14 and allow the retractable connector 24 to be slidingly extended and retracted. A portion of the compression spring 92 is preferably disposed within the opening 100 between the rails 96 and 98, but the compression spring may be located in any suitable location.

Figure 10:
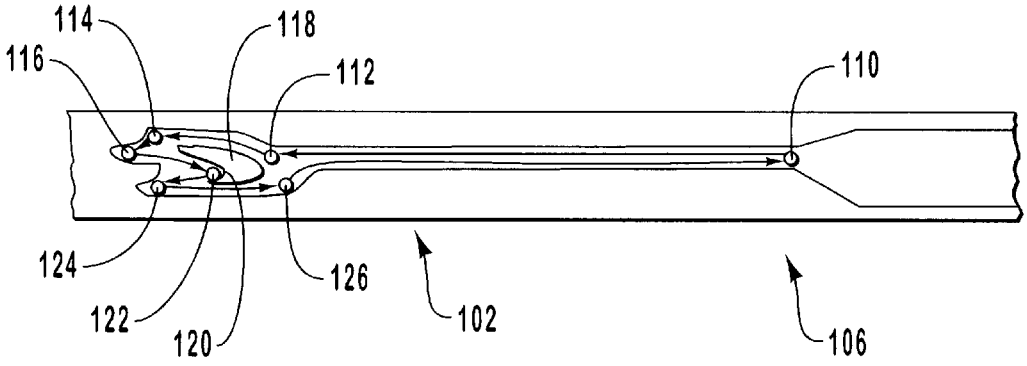
FIG. 10 is a side view of a cam track that is sized and configured to receive the cam follower shown in FIG. 9, illustrating the path followed by the cam follower as the retractable connector is extended and retracted from an electronic device such as the communication card.

As seen in FIGS. 9 and 10, the retractable connector 24 and communication card 14 includes a cam system 102 that holds the retractable connector in the extended or retracted position. The cam system 102 includes a cam follower 104 attached to the retractable connector 24 and a cam track 106 attached to in the communication card 14. Briefly, the cam track 106 is disposed along an inside surface of the body of the communication card 14 or other suitable electronic device, and the cam follower 104 follows the cam track as the connector 24 is extended and retracted. In greater detail, the cam follower 104 is rotatably connected to the retractable connector 24 such that the cam follower is allowed to rotate about a cam follower axis 108 as the cam follower 104 moves within the cam track 106. Thus, as the retractable connector 24 is extended or retracted, the cam follower 104 follows the cam track 106 and, as described below, the connector 24 is held in either a retracted or extended position.

Assuming that the retractable connector 24 is in an extended position, the cam follower 104 is located at a first position 110 within the cam track 106. To retract the connector 24 within the body of the communication card 14, a user depresses the connector and as the user depresses the connector, the cam follower 104 follows the arrows illustrated in the cam track 106 through positions 112, 114 and 116. As the cam follower 104 proceeds through these positions, the compression spring 76 is being extended and the torsion spring 82, for example, is being compressed. In embodiments including the compression spring 92 located along one edge of the connector 24, the compression spring is also being compressed as the user depresses the connector 24.

When the cam follower 104 is at position 116, the user ceases to depress the retractable connector 24 into the communication card 14 and the compression spring 92 and/or the torsion spring 82 begins to expand. The shape of the cam track 106 and the stop 118, however, causes the cam follower 104 to come to rest against a depression 120 in the stop, identified as position 122. Because the cam follower 104 is held against the stop 118 by the force provided by the compression spring 92 and/or torsion spring 82, the connector 24 is prevented from extending and the connector is effectively held in the retracted position.

To extend the retractable connector 24, a user depresses the connector and the shape of the cam track 106 causes the cam follower 104 to proceed from position 122 through positions 124 and 126. Because the cam track 106 positions the cam follower 104 such that the cam follower will not come into contact with the stop 118, the force provided by the spring extends the connector 24 until the connector is fully extended. When the connector 24 is fully extended, the cam follower 104 occupies the position 110. In this manner, the connector 24 may be repeatedly retracted and extended as needed.

One skilled in the art will appreciate that the compression spring 76 in the guide structure 50 can be arranged to provide either a force that assists in the extension of the connector 24 or in the retraction of the connector. As illustrated in FIG. 8, the compression spring 76 is compressed when the connector 24 is in an extended position. Thus, the compression spring 76 produces a force that opposes the forces provided by the torsion spring 82 and the compression spring 92. Preferably, the force provided by the compression spring 76 does not cause the connector 24 to inadvertently retract. Rather, the compression spring 76 assists a user in retracting the connector 24 and assists in preventing the connector from undesirable lateral movement. In another embodiment, the compression spring 76 and guidepost 52 can be positioned within the slot 54 such that the compression spring provides a force that assists in the extension of the connector 24.

Although this invention has been described in terms of certain preferred embodiments, other embodiments apparent to those of ordinary skill in the art are also within the scope of this invention. Accordingly, the scope of the invention is intended to be defined only by the claims that follow. Further, all changes that come within the meaning and range of equivalency of the claims are intended to be embraced within the claims.

What is claimed and desired to be secured by United States Letters Patent is:

1. An apparatus for use with an electronic device, the apparatus comprising:

a retractable connector that is movable between an extended position and a retracted position along an axis;

an elongated slot disposed within the retractable connector, the elongated slot including a width and a length;

a guide structure at least partially disposed within the elongated slot, the guide structure being adapted to guide the retractable connector generally along the axis as the retractable connector is moved between the extended position and the retracted position; and a compression spring positioned between the portion of the guide structure disposed within the elongated slot and an end of the elongated slot.

2. The apparatus as in claim 1, wherein a spring force of the compression spring is generally aligned with the axis in which the retractable platform is extended and retracted.

3. The apparatus as in claim 1, further comprising one or more antennas connected to the retractable connector.

4. The apparatus as in claim 1, further comprising two or more antennas that are separated by a distance of about 1.2 inches or more such that the antennas are compatible with Bluetooth technology or IEEE standard 802.11 for wireless communication.

5. The apparatus as in claim 1, further one or more chip-type antennas connected to the retractable connector.

6. An apparatus comprising:

a communication card including a first end and a second end, the communication card also including a housing with an upper surface and a lower surface;

a retractable connector attached to the communication card, the retractable connector being movable between an extended position and a retracted position along an axis;

an elongated slot disposed within the retractable connector, the elongated slot including a width and a length;

a guidepost connected to the communication card and disposed within the elongated slot, the guidepost being adapted to guide the retractable connector generally along the axis as the retractable connector is moved between the extended position and the retracted position; and a spring positioned between the retractable connector and the communication card, the spring including a spring force that is generally directed towards a center portion of the retractable connector and aligned with the axis as the connector is moved between the extended position and the retracted position, the spring being sized and configured to assist in moving the retractable connector between the retracted position and the extended position.

7. The apparatus as in claim 6, further comprising a compression spring positioned between the guidepost and an end of the elongated slot.

8. The apparatus as in claim 6, further comprising a transmission line attached to the spring, wherein the spring functions as a ground plane for the transmission line.

9. The apparatus as in claim 6, further comprising a flexible circuit attached to the spring, the flexible circuit being adapted to provide electrical communication between the retractable connector and the communication card.

10. The apparatus as in claim 9, further comprising zero insertion force connectors that are used to connect the flexible circuit to the communication card.

11. A platform attached to an electronic device, the platform adapted to facilitate electrical communication with the electronic device, the platform comprising:

a retractable connector attached to the electronic device, the retractable connector being movable between an extended position and a retracted position along an axis;

an elongated slot disposed within the retractable platform, the elongated slot including a width and a length;

a guidepost connected to the electronic device and disposed within the elongated slot, the guidepost being adapted to guide the retractable connector generally along the axis as the retractable connector is moved between the extended position and the retracted position; and a compression spring disposed within the elongated slot, the compression spring including a first end abutting the guidepost and a second end abutting an end of the elongated slot.

12. The platform as in claim 11, further comprising at least two receiving portions connected to the retractable connector; and wherein the elongated slot is generally centrally disposed with respect to the retractable connector.

13. The platform as in claim 12, wherein the receiving portions comprise antennas for communication with a wireless network.

14. The platform as in claim 11, further comprising a spring positioned between the retractable connector and the electronic device, wherein the spring is positioned such that a spring force is generally directed towards a center portion of the retractable connector.

15. The platform as in claim 14, further comprising a flexible circuit attached to the spring, the flexible circuit adapted to provide electrical communication between the retractable connector and the electronic device.

16. The platform as in claim 11, further comprising an antenna attached to the retractable connector.

17. The platform as in claim 11, further comprising two antennas attached to the retractable connector, the antennas being separated by a distance of at least one inch.

18. The platform as in claim 11, further comprising at least one receptacle attached to the retractable connector and at least one antenna attached to the retractable connector.

19. The platform as in claim 11, further comprising a plurality of antennas attached to the retractable connector, the antennas being separated by a suitable distance to allow the antennas to be used with Bluetooth technology.

20. The platform as in claim 11, further comprising a plurality of antennas attached to the retractable connector, the antennas being separated by a suitable distance to allow the antennas to be used with a system that is compatible with IEEE standard 802.11.

21. A communication card for use with an electronic device, the communication card comprising:

a housing including an upper surface and a lower surface;

a retractable connector attached to the housing of the communication card, the retractable connector movable between an extended position and a retracted position;

an elongated slot generally centrally disposed within the retractable connector, the elongated slot being generally aligned with an axis with which the retractable connector is moved between the extended position and the retracted position;

a guidepost disposed within the elongated slot; and a spring including a first end connected to the retractable connector, the spring having a spring force that is generally aligned with the axis with which the retractable connector is moved between the extended position and the retracted position.

22. The communication card as in claim 21, wherein the guidepost is connected to the upper surface of the housing and the lower surface of the housing to increase the structural integrity of the housing and to prevent the retractable connector from being unintentionally removed from the housing.

23. The communication card as in claim 21, further comprising one or more antennas connected to the retractable connector.

24. The communication card as in claim 21, further comprising two or more antennas that are separated by a distance of about 1.2 inches or more such that the antennas are compatible with Bluetooth technology or IEEE standard 802.11 for wireless communication.

25. The communication card as in claim 21, further one or more chip-type antennas connected to the retractable connector.

26. The communication card as in claim 21, where the spring is a compression spring that is disposed between the guidepost and an end of the elongated slot in the retractable connector.

27. The communication card as in claim 21, wherein the spring has a generally constant spring force.

28. The communication card as in claim 21, wherein the spring has a generally linear spring force.

29. The communication card as in claim 21, wherein the spring is disposed between an inner portion of the communication card and an end of the retractable connector, and wherein a second end of the spring is connected to the inner portion of the communication card.

30. The communication card as in claim 29, further comprising a notch in the retractable connector that is sized and configured to receive at least a portion of the spring when the retractable connector is in the retracted position.

31. The communication card as in claim 29, further comprising a flexible circuit attached to the spring, the flexible circuit adapted to provide electrical communication between the retractable connector and the communication card.

* * * * *